US006357513B1

(12) United States Patent
Janezich et al.

(10) Patent No.: US 6,357,513 B1
(45) Date of Patent: Mar. 19, 2002

(54) SUPPORT FOR HEAT EXCHANGER TUBES

(75) Inventors: Robert Janezich, Hibbing; Todd G. Dosen, Side Lake, both of MN (US)

(73) Assignee: L&M Radiator, Inc., Hibbing, MN (US)

( * ) Notice: Subject to any disclaimer, the term of this patent is extended or adjusted under 35 U.S.C. 154(b) by 0 days.

(21) Appl. No.: 09/493,382

(22) Filed: Jan. 28, 2000

Related U.S. Application Data

(60) Provisional application No. 60/117,817, filed on Jan. 29, 1999.

(51) Int. Cl.[7] ..... F28F 9/00; F22B 37/24

(52) U.S. Cl. ..... 165/67; 165/162; 122/510

(58) Field of Search ..... 165/162, 172, 165/67, 171; 122/510, 512

(56) References Cited

U.S. PATENT DOCUMENTS

| | | | | | |
|---|---|---|---|---|---|
| 1,972,230 | A | * | 9/1934 | Lehman | 165/184 |
| 2,468,924 | A | | 5/1949 | Courtier | 285/30 |
| 3,391,732 | A | | 7/1968 | Murray | 165/76 |
| 3,494,414 | A | | 2/1970 | Warner | 165/82 |
| 3,854,529 | A | * | 12/1974 | Sagan | 165/162 |
| 3,905,420 | A | * | 9/1975 | Wirth et al. | 165/67 |
| 3,934,645 | A | * | 1/1976 | Butts | 165/172 |
| 3,955,788 | A | * | 5/1976 | Delage | 248/228.3 |
| 3,998,268 | A | * | 12/1976 | Sagan | 165/162 |
| 4,026,456 | A | | 5/1977 | Lema | 228/136 |
| 4,167,211 | A | * | 9/1979 | Haller | 165/172 |
| 4,216,824 | A | * | 8/1980 | Braun et al. | 165/172 |
| 4,344,478 | A | | 8/1982 | Petaja et al. | 165/69 |
| 4,356,795 | A | * | 11/1982 | Loiez et al. | 122/511 |
| 4,421,160 | A | | 12/1983 | Stafford et al. | 165/76 |
| 4,547,943 | A | | 10/1985 | Hoeffken | 29/157.3 R |
| 4,570,704 | A | | 2/1986 | Braun et al. | 165/162 |
| 4,651,821 | A | | 3/1987 | Moranne | 165/175 |
| 4,773,475 | A | | 9/1988 | Sleep, Jr. | 165/76 |
| 4,930,568 | A | | 6/1990 | Janezich et al. | 165/76 |
| 4,993,485 | A | | 2/1991 | Gorman | 165/85 |
| 5,027,495 | A | | 7/1991 | Usui et al. | 29/450 |
| 5,236,045 | A | | 8/1993 | Janezich et al. | 165/183 |
| 5,433,268 | A | | 7/1995 | Janezich et al. | 165/76 |
| 5,467,818 | A | | 11/1995 | Buckley, Jr. | 165/178 |
| 5,697,426 | A | * | 12/1997 | Matuszczak et al. | 165/67 |

FOREIGN PATENT DOCUMENTS

| | | | | |
|---|---|---|---|---|
| DE | 891 994 | | 10/1953 | |
| EP | 0 481 178 | | 4/1992 | |
| FR | 418 770 | | 10/1910 | |
| SU | 001677482 | * | 9/1991 | 165/162 |

* cited by examiner

*Primary Examiner*—Ira S. Lazarus
*Assistant Examiner*—Tho Van Duong
(74) *Attorney, Agent, or Firm*—Banner & Witcoff, Ltd.

(57) ABSTRACT

A novel individual support for a heat exchanger is disclosed which frictionally engages the outer surface of a tube-and-fin assembly and provides for interlocking of the supports. The novel support includes an alignment probe to facilitate installation and to prevent axial movement of the support.

16 Claims, 5 Drawing Sheets

SUPPORT FOR HEAT EXCHANGER TUBES

This application claims the benefit of U.S. Provisional patent application Ser. No. 60/117,817, filed Jan. 29, 1999.

BACKGROUND OF THE INVENTION

1. Field of the Invention

Embodiments of the present invention relate generally to a heat exchanger having tube-and-fin assemblies, such as found in a diesel engine cooling system, and more particularly to a support for the tube-and-fin assemblies such that alignment of the tubes and the overall strength and rigidity of the heat exchanger is enhanced.

2. Description of Related Art

A heat exchanger includes a multiplicity of tube-and-fin assemblies. The tube-and-fin assemblies are mounted in headers, arranged in columns and rows, and interconnected to receive and pass a heating/cooling fluid (dependent upon application). These tube-and-fin assemblies may be of the removable type or soldered in place. In certain environments, the tube-and-fin assemblies must have considerable length in order to provide sufficient heat transfer. The rigidity of the assembly decreases with increased length, and thus it is often necessary in such applications to include a central header, in essence splitting the tube-and-fin assemblies in half. Utilization of a central header does, however, substantially increase cost and reduce fin surface area, thereby requiring a larger heat exchanger to achieve a given heat transfer capacity.

Each tube-and fin assembly may be designed to be easily removable from the headers for repair and/or replacement. See for example FIG. 8 of U.S. Pat. No. 4,216,824. The tube-and-fin assemblies may also be soldered or otherwise secured in place. Typical tube-and-fin assemblies include a generally elliptical tube having flat or flattened sides and a pair of heat-dispensing fins secured along the flat sides of the tube. In such a design, the fin elements may be individually attached to the flow tube or they may be in the form of a corrugated fin strip. The flow tube may extend beyond or be coextensive with the fin elements, or alternatively, the fin elements may extend beyond the flow tube. In another type of assembly, the tube configuration is substantially circular in cross section. As is well known in the art, the fluid passes through the tube and heat therefrom is dispensed by the fins into the environment. Examples of tube and fin element designs useful in the present invention are shown in U.S. Pat. Nos. 4,570,704; 4,344,478; 4,216,824; 3,391,732; 5,433,268; and 5,236,045 each of which are hereby incorporated by reference in its entirety for all purposes.

To ensure proper operation and sufficient heat transfer (e.g., cooling of the fluid in a radiator application and heating of the environment in a heat recovery application), it is desirable to maintain the spacing between tube-and-fin assemblies and to substantially control movement and/or vibration, without substantial forfeiture of fin surface area. Movement and vibration of the tube-and-fin assemblies, as a result of operation or impact, can produce serious damage due to (i) excessive movement or deflection of individual assemblies, or (ii) contact between adjacent assemblies. In addition, loss of fin surface area such as by removal of fins from the flow tube, renders the heat exchanger less effective for a particular application.

It is possible to essentially band together the rows and/or columns of tube-and-fin assemblies, whether the fins are of the corrugated fin or circular fin type, through use of a continuous strip of metal or other suitable material used to confine and support the tube-and-fin assembly and thereby increase the strength and rigidity of the heat exchanger. See FIG. 4 of U.S. Pat. No. 4,216,824. These types of continuous strip supports may also be designed to prevent movement of the strip along the length of the flow tube. The use of continuous strip supports, unfortunately, substantially inhibits the ready removal and repair or replacement of any single damaged tube-and-fin assembly. To avoid the repair problem, various individual "spacers" are now available. One such spacer is shown in U.S. Pat. No. 4,216,824 and is designed to be inserted between fin elements and is held in place by friction between the fin elements and the spacer. One difficulty with this spacer and others presently available is that, with vibration or separation of the fin from the flow tube, the spacer can dislodge or separate from the tube-and-fin assembly, thereby becoming ineffective. In addition, the spacer causes stress on solder joints between fin elements and the flow tube since the spacers rely on fin strength and solder joints to transfer stress or load encountered by a heat exchanger. Further, the presently available spacers do not provide sufficient support in applications involving long tube-and-fin assemblies (e.g., in excess of forty inches in a typical vertical radiator application) or severe duty (e.g., an earth moving vehicle) to eliminate the need for center headers.

SUMMARY OF THE INVENTION

Embodiments of the present invention relate generally to an improved support for use in connection with the tube-and-fin assemblies of a heat exchanger. Importantly, the support is an individual support and is designed to be removably fastened to each individual tube-and-fin assembly and to removably engage adjacent supports so as to maintain the tube spacing and to enhance the strength and rigidity of the overall heat exchanger assembly. A row of supports of the present invention is advantageously capable of transferring significant load or other stress upon the heat exchanger through the row of supports themselves, rather than through the tube-and-fin assemblies thereby avoiding detrimental effects to the tube-and-fin assemblies such as weakening of the solder joints between fin elements and a flow tube.

Since the supports of the present invention can be separately removed from adjoining supports in the heat exchanger core, they advantageously provide for removal of individual tube-and-fin assemblies when necessary. The supports are further designed to engage an individual tube-and-fin assembly in a wrap around fashion such that existing fin elements of a tube-and-fin assembly need not be removed prior to installation of the supports, as with certain prior art tube supports. In this manner, the supports may simply engage an existing tube-and-fin assembly without eliminating existing fin surface area for heat transfer capabilities.

The supports are further characterized in having an alignment probe which assists in the installation of individual supports into a series of tube-and-fin assemblies. The alignment probe further advantageously prevents the support from moving in an axial direction along the length of the tube-and-fin assembly. In addition, due to the wrap around nature of the supports, the supports of the present invention reduce stress on solder joints which may be used to fixedly mount fin elements to flow tubes thereby reducing possibility of solder joint failure.

In its simplest aspect, one embodiment of the present invention is directed to an integral, wrap-around individual support designed to frictionally engage a tube-and-fin assembly encompassing the fin elements at the front and side planes of the tube-and-fin assemblies by using front and side engagement surfaces. The support is advantageously designed to allow removal of individual tube-and-fin assemblies. An alignment extension is provided (1) which advantageously allows for proper spacing between rows of tube-and-fin assemblies of adjacent rows, (2) which advantageously allows for proper row to row alignment, i.e. in-line or staggered column configurations and (3) which advantageously provides additional support between adjacent rows of tube-and-fin assemblies. One embodiment of the individual support of the present invention also includes an alignment probe which frictionally engages adjacent fin elements to assist in installation of the support and also to prevent movement along the axial length of the tube-and-fin assembly. Advantageously, the supports are interconnecting or interlocking to maintain proper spacing between tube-and-fin assemblies in a given row, to prevent movement between adjacent tube-and-fin assemblies in a given row and to provide a force distribution system along the row as opposed to through the tube-and-fin assemblies themselves thereby reducing tensile stress on the solder joints. Any force executed upon the heat exchanger is thus spread and dissipated through the row of interconnected supports, substantially improving the strength and rigidity of the heat exchanger. In addition, the supports require no additional devices different from the supports themselves to interlock or otherwise secure the tube-and-fin assemblies at the edges of a particular heat exchanger.

It is thus an object of the present invention to provide an improved support for use with tube-and-fin assemblies of heat exchangers, where the support frictionally engages the outer surface area of tube-and-fin assembly. The tube-and-fin assemblies may be of the removable type. Another object is an improved support having interconnecting capacity to increase the strength and rigidity of the heat exchanger. A further object is an improved, interconnecting support which does not significantly reduce the fin surface area of an existing tube-and-fin assembly. A still further object of the present invention is an improved support which reduces or eliminates movement of the support in the axial direction along the length of the tube-and-fin assembly, and otherwise maintains its original position.

It is also an object of the present invention to provide an improved assembly support readily adaptable to various tube-and-fin configurations. It is a further object to provide an improved support for use with long tube-and-fin assemblies, so as to reduce or eliminate the need for a center header plate. Still another object is an improved assembly support which is readily removable and does not interfere with removal of individual tubes and whereby the individuality of the assemblies is maintained, thereby facilitating inspection, removal, repair, and replacement of individual tube-and-fin assemblies.

Other objects, features or advantages of the present invention will become apparent from the following description taken in conjunction with the accompanying drawings.

BRIEF DESCRIPTION OF THE DRAWINGS

In the course of the detailed description of certain preferred embodiments to follow, reference will be made to the attached drawings, in which.

DETAILED DESCRIPTION OF CERTAIN PREFERRED EMBODIMENTS

Figure 1:
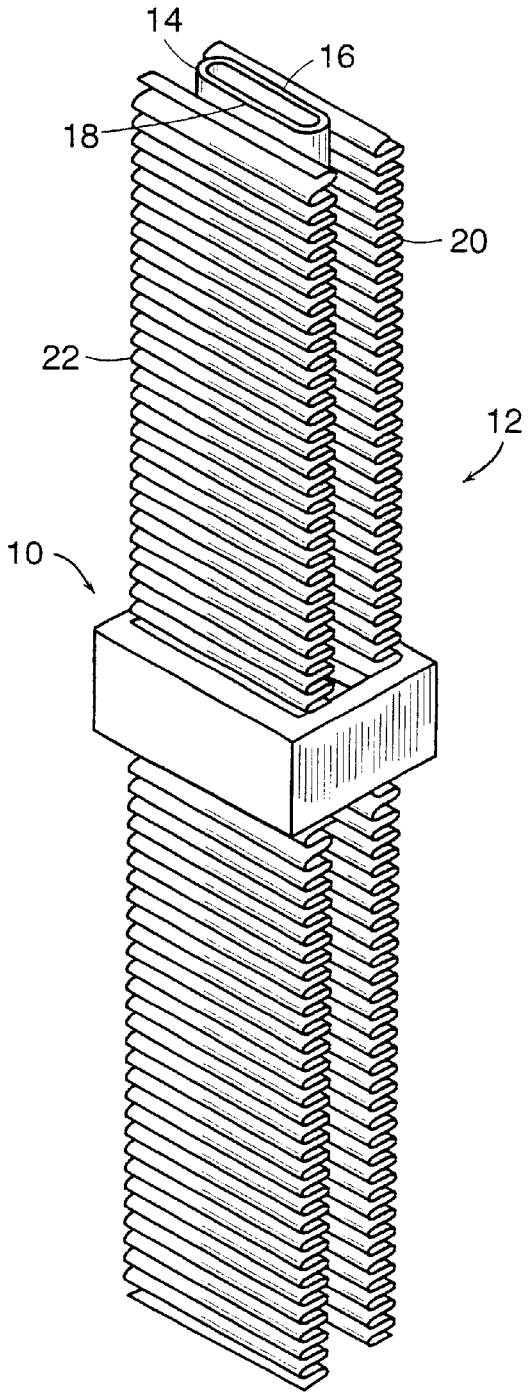
FIG. 1 depicts a prior art tube-and-fin assembly including a support generally depicted as a elastomeric ring which encircles the fin-and-tube assembly.

The principles of the present invention may be applied with particular advantage to provide an improved support for use with tube-and-fin assemblies as commonly found as part of a heat exchanger. More particularly, the heat exchanger includes a multiplicity of tube-and-fin assemblies 12, an example of which is depicted in FIG. 1, which are arranged in rows and columns and interconnected between upper and lower headers (not shown). The rows extend longitudinally across the heat exchanger, substantially perpendicular to the direction of air flow, and the columns are substantially perpendicular to the rows. The columns, for example, may be "in-line" or "staggered" (also referred to herein as "off set") as shown below (top view of tube-and-fin assemblies):

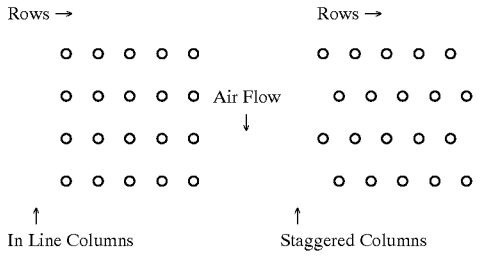

It is to be understood that alternate staggered designs are within the scope of the present invention such as a staggered design where tube-and-fin assemblies of every fourth row are aligned.

FIG. 1 depicts a prior art tube-and-fin assembly including a generally elliptical tube 14, having flat sides 16 and 18, and a pair of corrugated heat-dispensing fins 20 and 22 secured along the flat sides 16 and 18. The support 10 is shown as a unit which encircles the tube-and-fin assembly and may be secured to the tube-and-fin assembly 12 with or without removal of fin material.

For purposes of the present invention it is to be understood that the tube-and fin-assembly may have virtually any configuration such as that depicted in FIG. 1 or such as the angled fin configuration disclosed in U.S. Pat. No. 5,236,045. The fin elements may be individual fin elements fixedly mounted to opposite sides of a flow tube or they may be of the corrugated fin type as shown in the U.S. Pat. No. 5,236,045. The flow tube may be cylindrical, as seen in FIG.

7, or oblong having two substantially flat surfaces. The flow tube may extend to or beyond the fin elements. Alternatively, the fin elements may extend beyond the flow tube.

Figure 2:
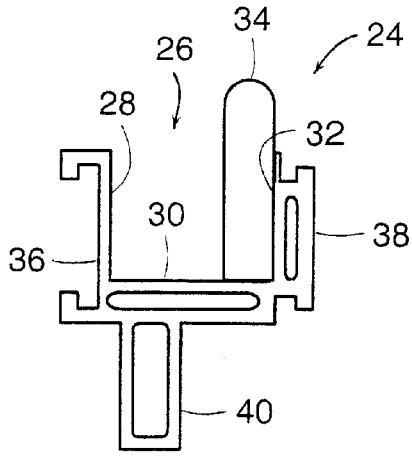
FIG. 2 is a cross-sectional view of the support of the present invention.
Figure 3A:
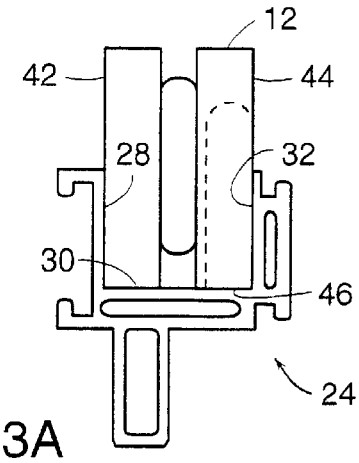
FIG. 3A is a cross-sectional view of the support of the present invention engaging a tube-and-fin assembly.

FIG. 3A depicts a support 24 of the present invention attached to a tube-and-fin assembly. FIG. 2 depicts in cross-section, the support 24 of the present invention. The support 24 is shown as an integral unit, however, it may be fabricated from individual parts glued or welded together or otherwise interconnected. The support is manufactured from a temperature and fluid resistant material, such as metal or thermoplastic appropriate to the particular application. The support 24 may be machined or injection molded. The support is designed to have a tolerance to allow stretching or bending to accommodate installation and frictional adherence to a tube-and-fin assembly.

Support 24 includes a central channel 26 configured to receive the tube-and-fin assembly 12. The central channel 26 is formed from walls 28, 30 and 32 and is designed to conform generally to the rectangular configuration of the tube-and-fin assembly 12 of FIG. 1. It is to be understood that alternate geometries for tube-and-fin assemblies and accordingly supports to frictionally engage those geometries are within the scope of the present invention. Wall 28 contacts the outer surface of fin elements 22 and wall 32 contacts the outer surface of fin elements 20. In FIG. 1, the outer surface of the fin elements is understood to be the surface of the fin elements which do not contact the flow tube 14 and which form a plane parallel to the direction of flow across the tube-and-fin assembly. Wall 30 contacts what is termed herein as the front face of the tube-and-fin assembly. In FIG. 1, the front face of the fin elements is understood to be the surface of the fin elements which form a plane perpendicular to the direction of flow of air across the tube-and-fin assembly. In general, the front face of the tube-and-fin assembly despite its particular geometry is characterized by a plane perpendicular to the direction of flow of air across the tube-and-fin assembly. It is to be understood that the support of the present invention may be installed on either the front or back face of tube-and-fin assemblies and may be configured to engage any particular geometry of tube-and-fin assembly. The support 24 and walls 28, 30, and 32 are configured to frictionally engage the tube-and-fin assembly. Accordingly, the geometry of the central channel 26 is such that it is slightly smaller than, equal to or only slightly larger than the tube-and fin assembly. In this manner, the walls of the support 24 are slightly elastic such that they will frictionally accommodate, and thereby remain secured to, the tube-and-fin assembly. According to one embodiment of the present invention, the supports of the present invention are installed in a slidable fashion by simply forcing the support onto the front face of the tube-and-fin assembly until the wall 30 contacts the front face of the tube-and-fin assembly.

Support 24 also includes alignment probe 34 which is generally seen as a projection fixedly secured to wall 30 and wall 32. Alternatively, alignment probe 34 may be fixedly secured to wall 28 and 30 or simply fixed to either side wall 28 or 32. Alignment probe 34 is shown to be positioned mid way between the top and bottom of the support 24, although it may be positioned in any manner which allows it to be inserted between fin elements. The alignment probe 34 is depicted in FIG. 2 to be extending beyond the wall 32 although it may also be coextensive with wall 32. Alternatively wall 32 may extend beyond alignment probe 34. Alignment probe 34 is configured to frictionally engage between individual fin elements positioned at one side of the flow tube 14. According to a preferred embodiment, alignment probe 34 extends beyond wall 32 and is first inserted between individual adjacent fin elements on one side of flow tube 14 prior to walls 28, 30 or 32 contacting the tube-and-fin assembly. In this manner, the alignment probe acts as a guide for installation of the support 24. The alignment probe has dimensions which are slightly smaller than, equal to, or slightly larger than the spacing between two adjacent individual fin elements. In this manner, the alignment probe frictionally engages the space between the two individual fin elements and is held in place. In a further preferred embodiment, the alignment probe is inserted between adjacent individual fin elements of a corrugated fin structure, such as depicted in FIG. 1, such that the alignment probe is not contained within the fin element but rather is exposed to the outer surface of the corrugated fin element. Alignment probe 34 also advantageously prevents movement of the support along the axial length of the tube-and-fin assembly since it is position between two adjacent fin elements fixedly mounted to the flow tube.

Figure 5:
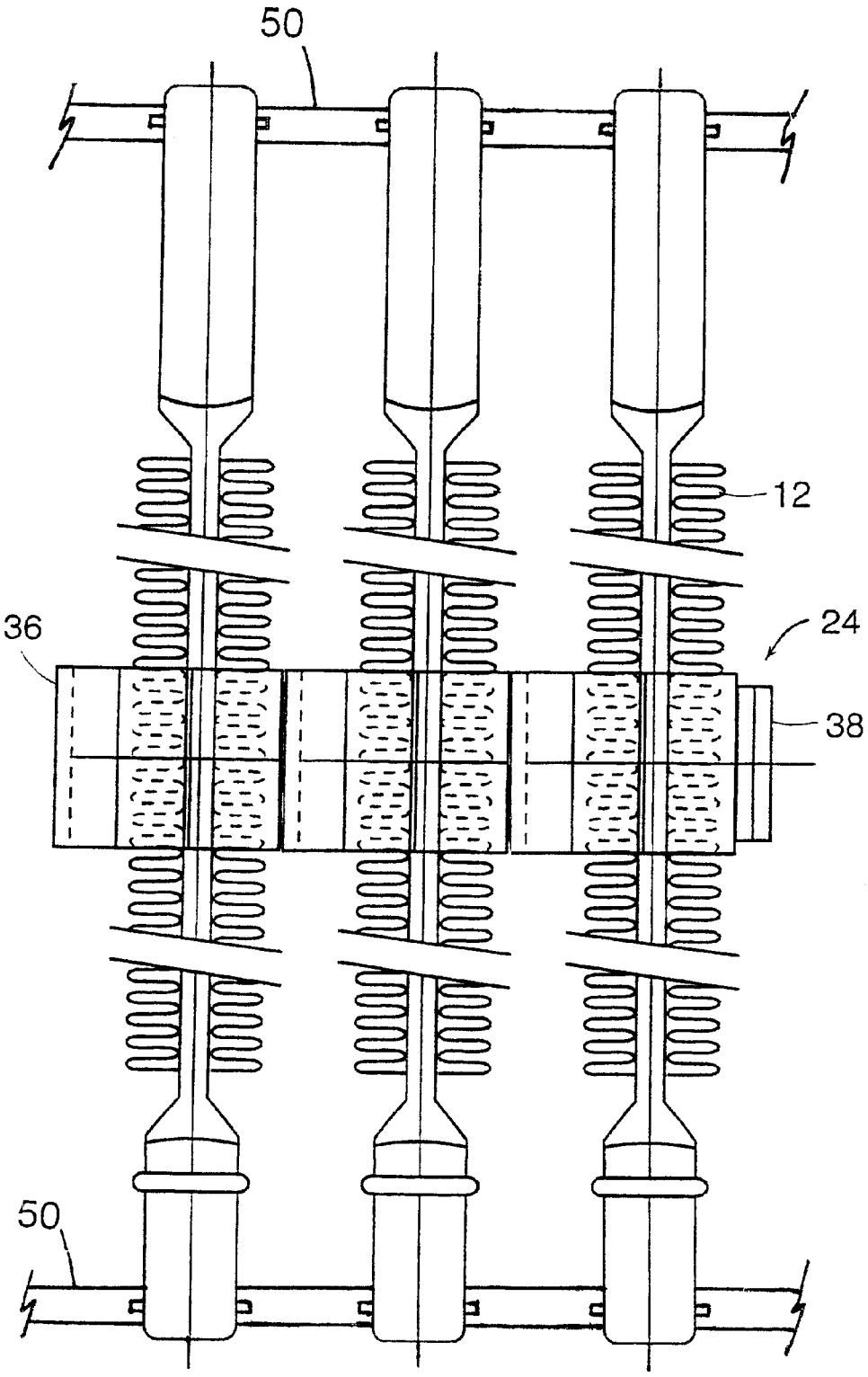
FIG. 5 is a front elevation view of a heat exchanger core showing rows of tube-and-fin assemblies between header plates in accordance with the present invention.
Figure 6:
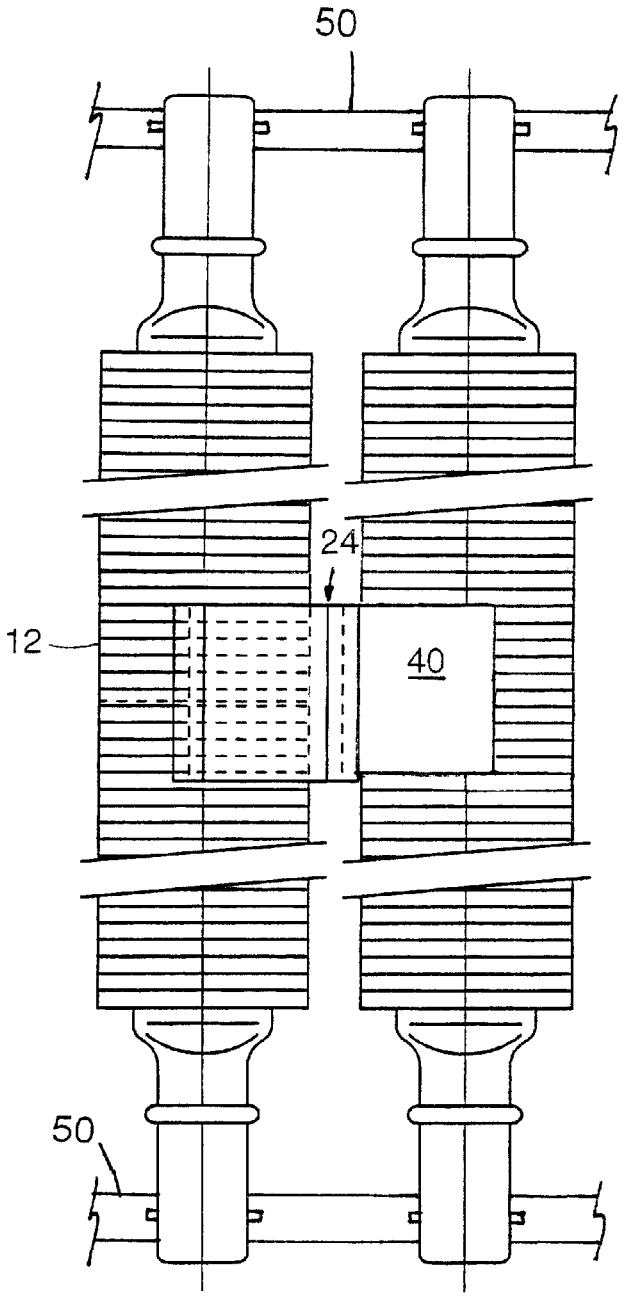
FIG. 6 is a side elevation view of a heat exchanger core showing columns of tube-and-fin assemblies between header plates in accordance with the present invention.
Figure 7:
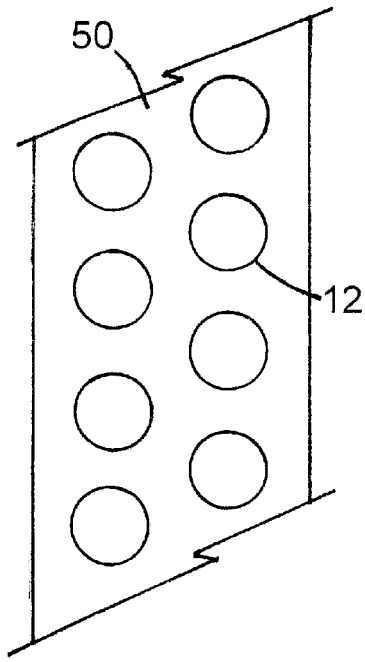
FIG. 7 is a plan view showing a circular tube of a tube-and-fin assembly and a corresponding header plate in accordance with the present invention.

Support 24 also includes female interlocking portion 36 and male interlocking portion 38. Two supports are removably connected by means of a male interlocking portion of one support and a female interlocking portion of an adjacent support. The male interlocking portion 38 is designed to slidably engage the female interlocking portion 36 of an adjacent support in an up and down manner when installed onto a tube-and-fin assembly. In this manner, a first support may be installed onto a first tube-and-fin assembly and a second support may then be installed onto a second tube-and-fin assembly. The second tube-and-fin assembly may then be raised or lowered relative to the first to engage the male interlocking portion of one relative to the female interlocking portion of another. This installation method may be continued to complete an entire row of supports interconnecting an entire row of tube-and-fin assemblies. The row of tube-and-fin assemblies may then be installed within appropriate header plates 50, as seen in FIGS. 5–6. Alternatively, individual tube-and-fin assemblies having a support installed thereon may be individually installed into a header plate 50 to complete a row of tube-and-fin assemblies interconnected by supports. The support of the present invention advantageously allows for the removal of a single tube-and-fin assembly should it become necessary since the supports allow movement in the up and down direction which is useful in tube removal as generally described in U.S. Pat. No. 4,216,824.

However, according to an alternate embodiment of the present invention, the male and female interlocking portions depicted in FIG. 2 may be rotated 90° to produce a support which may be interconnected in a slidable fashion by moving each support either front to back relative to one another should such be desirable.

Support 24 also includes alignment extension 40 which extends perpendicularly from wall 30 and provides a connection to, and proper spacing of, tubes in an adjacent row for increased core rigidity and proper row to row alignment. The alignment extension 24 becomes locked between tubes of adjacent rows which provides additional support in keeping them in place. In this manner, the tube-and-fin assembly at the ends of a row need not have any additional support installed other than the connection to the support of adjacent tube-and-fin assemblies. The alignment extension 40 also provides a means for grasping the support 24 during installation or removal. The alignment extension 40 is positioned along wall 30 in a manner to determine the positioning of the next adjacent row of tube-and-fin assemblies. For example, the alignment extension 40 can be positioned in a manner to produce an in line series of columns of tube-and-fin assemblies or a staggered series of columns of tube-and-fin assemblies. The thickness dimension of the alignment extension 40 also can be advantageously used to space adjacent tube-and-fin assemblies in an adjacent row.

FIG. 3A depicts a cross-sectional view of the support 24 of the present invention engaging a tube-and-fin assembly, such as that depicted in FIG. 1. As can be seen in FIG. 3A, the support 24 engages the tube-and-fin assembly in a wrap around fashion. By wrap around fashion is meant that the support engages at least the front face and the two side faces. Alternatively, wrap around fashion may also include that the support may engage the back face and the two side faces or any or all of the front face, the back face and the two side faces.

Figure 3B:
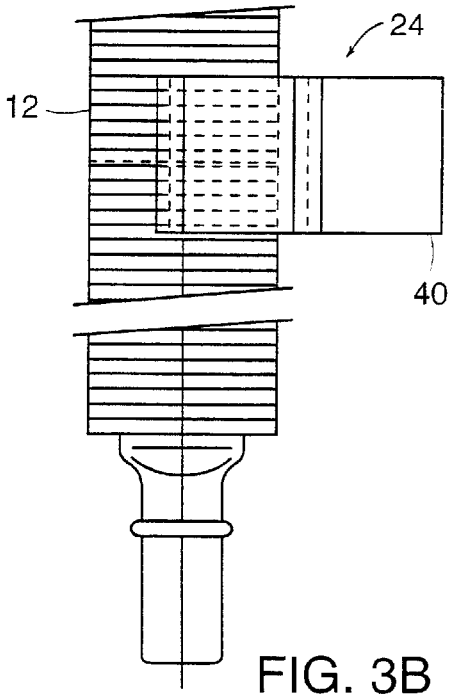
FIG. 3B and FIG. 3C are side and front views respectively of the support of the present invention engaging a tube-and-fin assembly.
Figure 3C:
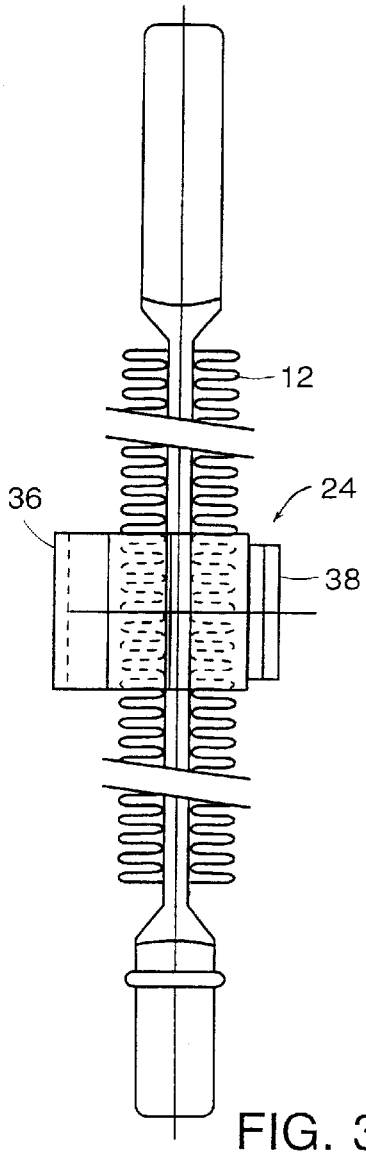

Wall 28 engages outer surface 42 of fin element 22. Wall 32 engages outer surface 44 of fin element 20. Wall 30 engages front face 46 of the tube-and-fin assembly 12. Support 24 is designed such that it frictionally engages the tube-and-fin assembly and remains adhered thereto by means of the walls 28, 30, and 32. As further depicted in FIG. 3A, alignment probe 34 is inserted into the space between adjacent fin elements on one side of the flow tube. The alignment probe provides additional friction between support 24 and the tube-and-fin assembly to assist in maintaining the support in place. The support including the alignment probe 34 also provides for the support to be locked between tubes of adjacent rows which provides for rigidity of the heat exchanger as a whole. In addition, the alignment probe prevents movement of the support 24 in an axial direction along the length of the tube-and-fin assembly since it is bounded by two adjacent individual fin elements. FIG. 3B is a partial side view of the tube-and-fin assembly including the support of the present invention. As can be seen, the support 24 is engaged with the side and front portions of the tube-and-fin assembly. FIG. 3C is a partial front view of the tube-and-fin assembly including the support of the present invention showing the female and male interlocking portions of the support.

Figure 4:
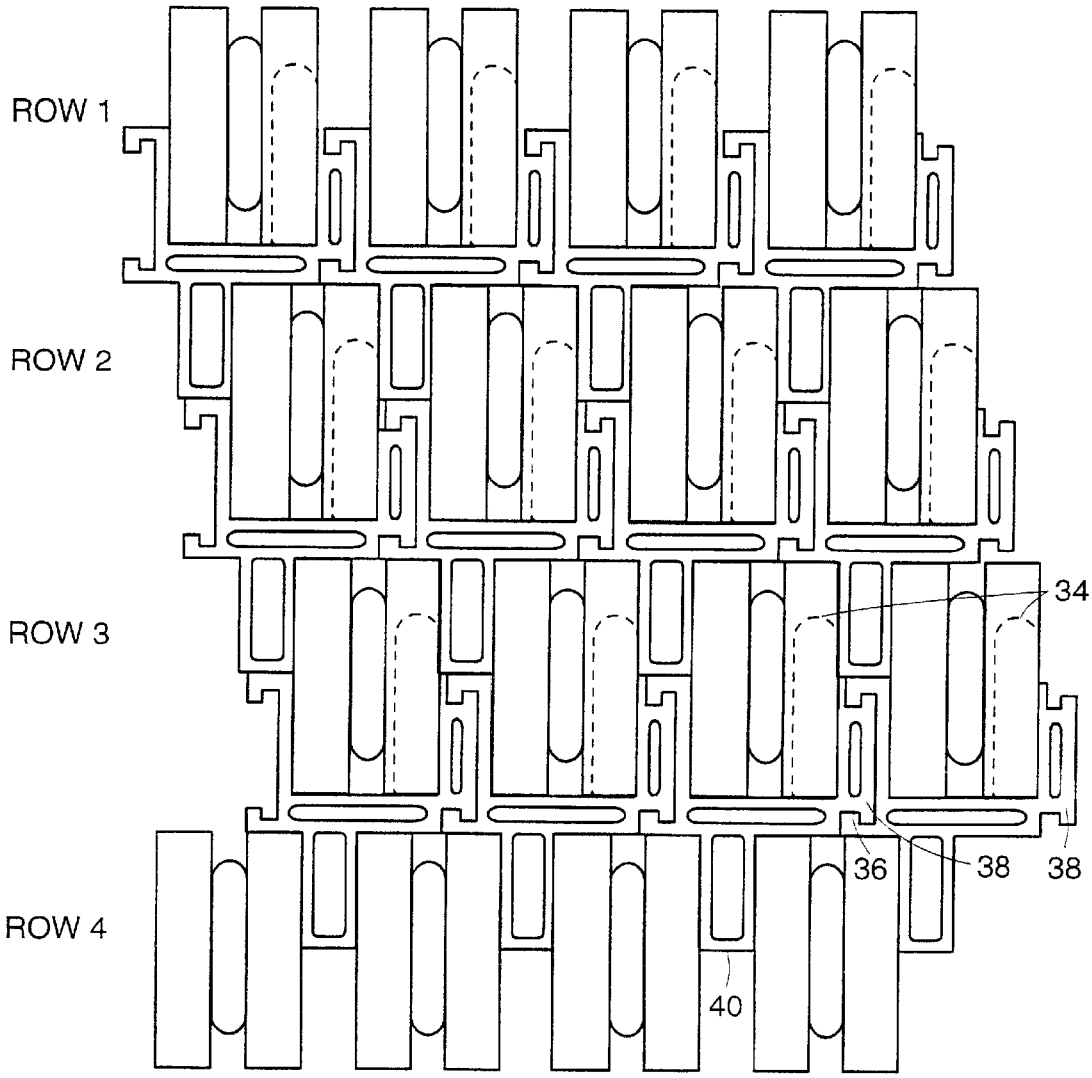
FIG. 4 is a cross-sectional view of a heat exchanger core including tube-and-fin assemblies interconnected by supports of the present invention.

FIG. 4 depicts in cross section a heat exchanger core of a staggered configuration including the supports of the present invention. As can be seen in FIG. 4, two adjacent tube-and-fin assemblies are interconnected by the supports of the present invention. The male interlocking portion 38 is slidably engaged within the female interlocking portion 36 of an adjacent support. It is to be understood that the male and female interlocking portions may be configured in any manner such that they will removably engage one another. The alignment extension is positioned along wall 30 in a manner to produce a staggered configuration. The alignment extension occupies the space between, and also contacts, two adjacent tube-and-fin assemblies in an adjacent row and serves to uniformly space tube-and-fin assemblies in an adjacent row while also providing additional support within the heat exchange as a whole. In this manner, an unlimited number of tube-and fin assemblies may be interconnected in series to provide a row, and an unlimited number of rows may be configured to produce columns. While it is envisioned that a single plane of supports of the present invention may be used in a heat exchanger, i.e. such as a single plane of supports midway between the top and bottom of the flow tubes and header plates, additional planes of supports may also be utilized to provide additional support within a given heat exchanger.

It is to be understood that the embodiments of the invention which have been described are merely illustrative of some applications of the principles of the invention. Numerous modifications may be made by those skilled in the art without departing from the true spirit and scope of the invention.

What is claimed is:

1. A support for use with tube-and-fin assemblies comprising a central channel for frictionally engaging the outer surface of a tube-and-fin assembly, a male interlocking portion, a female interlocking portion and an alignment probe interior to the central channel and configured to frictionally engage adjacent fin elements.

2. The support of claim 1 wherein the support further includes an alignment extension having a width sufficient to occupy space between two adjacent tube-and-fin-assemblies of an adjacent row of a heat exchanger.

3. The support of claim 2 wherein the male interlocking portion and the female interlocking portion are located on opposing ends of the support.

4. The support of claim 3 wherein the male interlocking portion of a first support is configured to slidably engage a female interlocking portion of a second support.

5. The support of claim 4 wherein the alignment extension is positioned to produce an in line core configuration.

6. The support of claim 4 wherein the alignment extension is positioned to produce a staggered or off set core configuration.

7. A heat exchanger comprising:

a plurality of tube-and-fin assemblies, wherein each assembly comprises a tube and fin elements, the assemblies being interconnected between headers and arranged in rows and columns in a manner to provide spacing between the rows and columns, and one or more supports connected to the assemblies, each support comprising a central channel for frictionally engaging the outer surface of a tube-and-fin assembly, a male interlocking portion, a female interlocking portion and an alignment probe interior to the central channel and configured to frictionally engage adjacent fin elements.

8. The heat exchanger of claim 7, wherein the tube is an elliptical tube.

9. The heat exchanger of claim 7, wherein the tube is a circular tube.

10. The heat exchanger of claim 7, wherein the fin elements are individually attached to the tube.

11. The heat exchanger of claim 7, wherein the fin elements are a corrugated fin strip.

12. The heat exchanger of claim 7, wherein the tube-and-fin assemblies have an in line configuration.

13. The heat exchanger of claim 7 wherein the tube-and-fin assemblies have a staggered configuration.

14. The heat exchanger of claim 7 wherein the support further includes an alignment extension having a width sufficient to occupy space between two adjacent tube-and-fin assemblies.

15. The heat exchanger of claim 7 wherein the male interlocking portion and the female interlocking portion are located on opposing ends of the support.

16. The heat exchanger of claim 15 wherein the male interlocking portion of a first support is configured to slidably engage a female interlocking portion of a second support.

* * * * *